United States Patent [19]

Parsons

[11] 3,974,799

[45] Aug. 17, 1976

[54] CALF ROPING TRAINING AID

[76] Inventor: Donald Parsons, Rte. 5, Box 143, Walla Walla, Wash. 99362

[22] Filed: June 2, 1975

[21] Appl. No.: 583,119

[52] U.S. Cl. ..... 273/105.2; 119/29
[51] Int. Cl.[2] ..... F41J 9/00
[58] Field of Search ..... 119/29; 273/105.2

[56] References Cited

UNITED STATES PATENTS

| | | | |
|---|---|---|---|
| 3,711,098 | 1/1973 | McCord | 273/105.2 |
| 3,802,706 | 4/1974 | Hamn | 273/105.2 |

*Primary Examiner*—Hugh R. Chamblee
*Attorney, Agent, or Firm*—Wells, St. John & Roberts

[57] ABSTRACT

A training aid for calf roping comprises a calf shaped body supported by horizontal and upright skid runners. The runners hold the body above ground to be pulled along as a roping target for a calf roper. The calf shaped body includes a head portion that is tapered smoothly from a forward body end to a nose end. When a loop from a lariat is passed over the head and pulled rearwardly, the body will respond by rocking rearwardly. As the body rocks rearwardly, the head moves from a forward position to a rearward position wherein the nose end points rearward and the body rides on the upright skids. The loop is then released as it slides rearwardly over the tapered head. Once the loop has been released, a continued forward pulling force against the body will rock the body back into a normal position.

7 Claims, 7 Drawing Figures

FIG 1
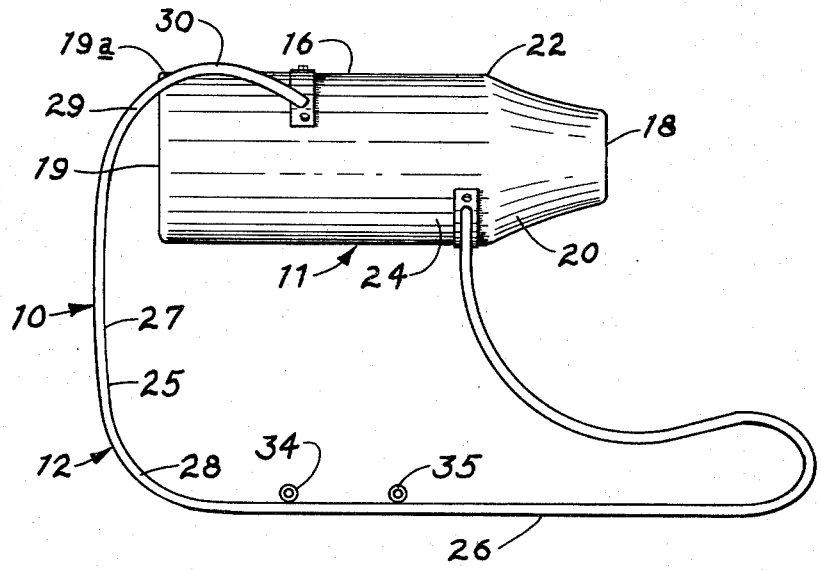
FIG 2
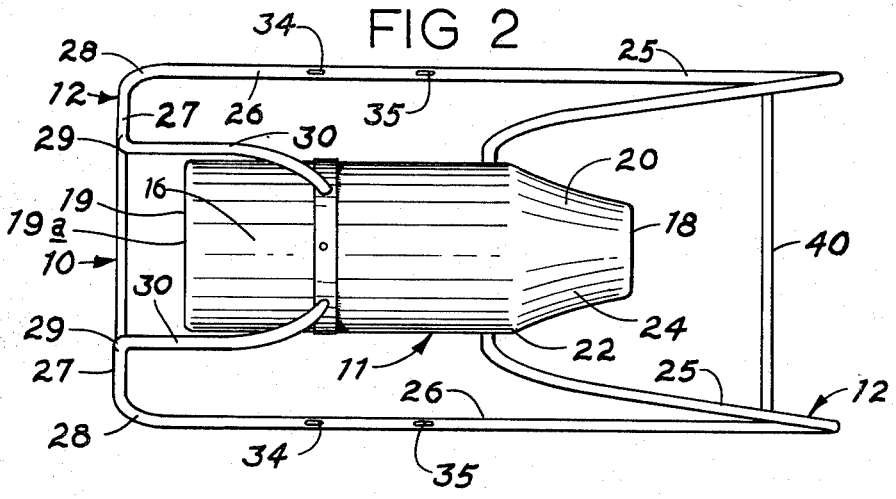
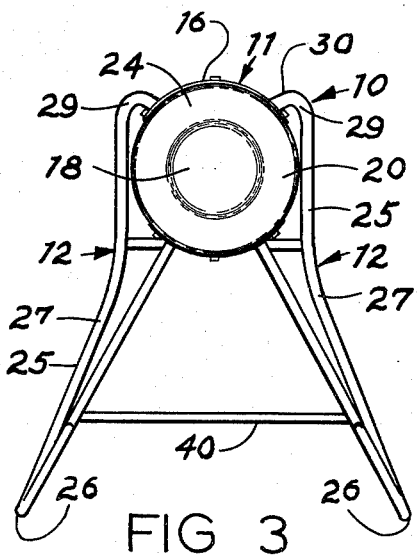
FIG 3
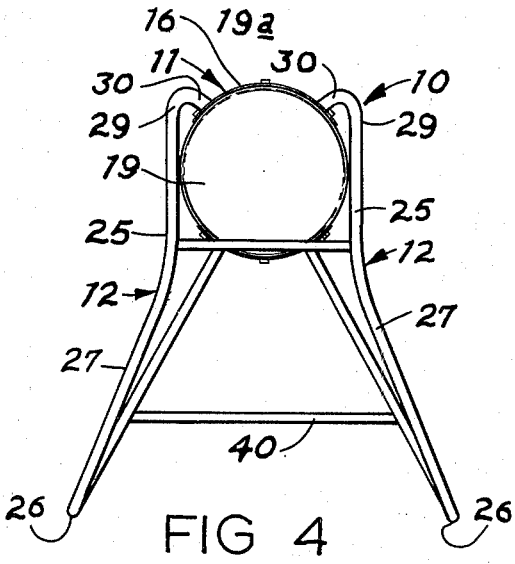
FIG 4

CALF ROPING TRAINING AID

BACKGROUND OF THE INVENTION

The present invention is related to roping training devices and more particularly to such roping training devices that are moved along the ground by an external power source to provide a moving target for a mounted calf roper.

Calf roping is a major rodeo event wherein a calf is turned loose from a chute and runs, hopefully, straight away from the chute into an arena. A rider is stationed along one side of the chute and, after a short delay, is set loose to lasso, throw, and "hogtie" the running calf. The elapsed time is measured from the instant the rider leaves the chute until he lassos, throws, and "hogties" three of the calf's legs together. At the end of the event, the rider with the lowest elapsed time is designated the winner of the event.

Obviously, a great deal of practice is required to become adept at calf roping. It is a very difficult procedure to ride a horse at full gallop, often at speeds of 40 mph, and accurately throw a loop over the head of a running calf. It is also difficult to train a horse properly for this event. Practice with live calves has proven to be dangerous to the calves and a rather tedious operation. Firstly, since the practice is usually continued over a substantial length of time, several calves must be utilized. Therefore, the calves must be held in a restricted area and taken one by one to a simulated chute and arena where the roper practices chasing, roping, throwing, and hogtying each calf. The calves tire easily after being roped several times and must therefore be replaced. An important part of calf roping is training the roping horse and learning the rope throwing technique. It has been found desirable to use a mechanical device in place of live calves to reduce injury to the live animals and to hasten the learning procedure, both for the rider and horse.

Various mechanical devices have been designed to aid in the instruction and practice of calf roping. Ordinarily such devices include an external power source, usually an electric or gasoline motor, that either pulls the simulated calf along the ground or moves it along a track.

U.S. Pat. No. 3,711,098 discloses a portable mechanical lasso training apparatus having features similar to those described above. A stationary motor driven winch has a cable that extends to a simulated calf shaped structure. The structure is mounted on skids for sliding movement along the ground. Provisions are included within the simulated calf to guide it directionally as it is moved toward the stationary winch. The simulated calf is pulled along until lassoed; at which time the winch is actuated to stop. The rider may then dismount, remove the lasso, reposition the calf, remount, and start the winch operating again.

U.S. Pat. No. 3,776,553 discloses an animated mechanical steer having a spring biased head. This device is powered to move in a circular path at a center pivot. A radius arm connects the steer body to the pivot power source. The head is spring biased in order that it may move laterally in response to tension applied by a lasso loop thrown by a rider. The head includes simulated horns and the body includes "walking" legs. This device is therefore used in team roping wherein one rider ropes a steer's head while a second rider ropes that same steer's hind legs.

U.S. Pat. No. 3,802,706 discloses a motorized roping steer similar to that disclosed in U.S. Pat. No. 3,776,553 as described above, the only difference being that this simulated steer is powered independently of the center pivot by a gasoline engine. This simulated steer has outwardly projecting horns that will pivot rearwardly in response to pulling force against a lasso loop to enable release of the lasso loop from the rearwardly pivoted horns. No rocking motion of the device is incurred through the rearward pulling force, nor is the head of the simulated animal adapted to receive the loop of the lasso.

The track type device is exemplified in the Tisdell and McCain Pat. Nos. 3,406,969 and 3,324,832 wherein a simulated calf is carried on an elongated track to move about a continuous straight line circuit or along a straight track.

The present invention utilizes a simulated calf shaped body supported on runners. The runners enable the body to be pulled along the ground behind a horse and rider or other towing vehicle. The device is designed so that when a loop is thrown about a head portion and the lasso is pulled tight, the body will pivot about a horizontal axis to bring the nose portion to a rearwardly facing direction. The head is tapered so the lasso loop will be released from the rearwardly facing head. The body is then allowed to pivot back to a normal horizontal condition.

SUMMARY OF THE INVENTION

The calf roping training aid described herein is adapted to be towed along the ground in a forward direction as a roping target for a calf roper. The aid includes a calf shaped body with forward and rearwardly facing ends and a head portion at the forward body end that is adapted to receive and slidably release the loop of a lariat. The head portion tapers forwardly from the forward body end to a reduced nose end. A support means is provided to movably hold the body in a loop receiving position above the ground with the body and head portion oriented substantially parallel to the ground surface while being towed in the forward direction. A rocker means is provided that is responsive to a rearward force directed against the forward body end, to rock the body and head portion rearwardly about a horizontal axis toward a loop releasing position whereat the nose end of the head is pointing substantially rearwardly. In addition, a return means is included for rocking the body back to the loop receiving position.

It is a first object of my invention to provide a calf roping training aid that is not only useful in training ropers, but is also very useful in training roping horses.

It is another object to provide such an aid that may be pulled by any suitable motive source available and in any area where there is enough space for roping practice.

It is a further object to provide such a training aid that will eliminate the need to keep and feed calves specifically for roping practice and training.

It is another object of the present invention to provide a calf roping training aid that may be utilized continuously without requiring that the roper dismount and remove the lasso loop from around the head portion of the aid.

FIG. 1 is a side elevational view of the calf roping training aid.

FIG. 2 is a top elevational view of the calf roping training aid.

FIG. 3 is a front view of FIG. 1.

FIG. 4 is a rear view of FIG. 1.

DETAILED DESCRIPTION OF A PREFERRED EMBODIMENT

Figure 5:
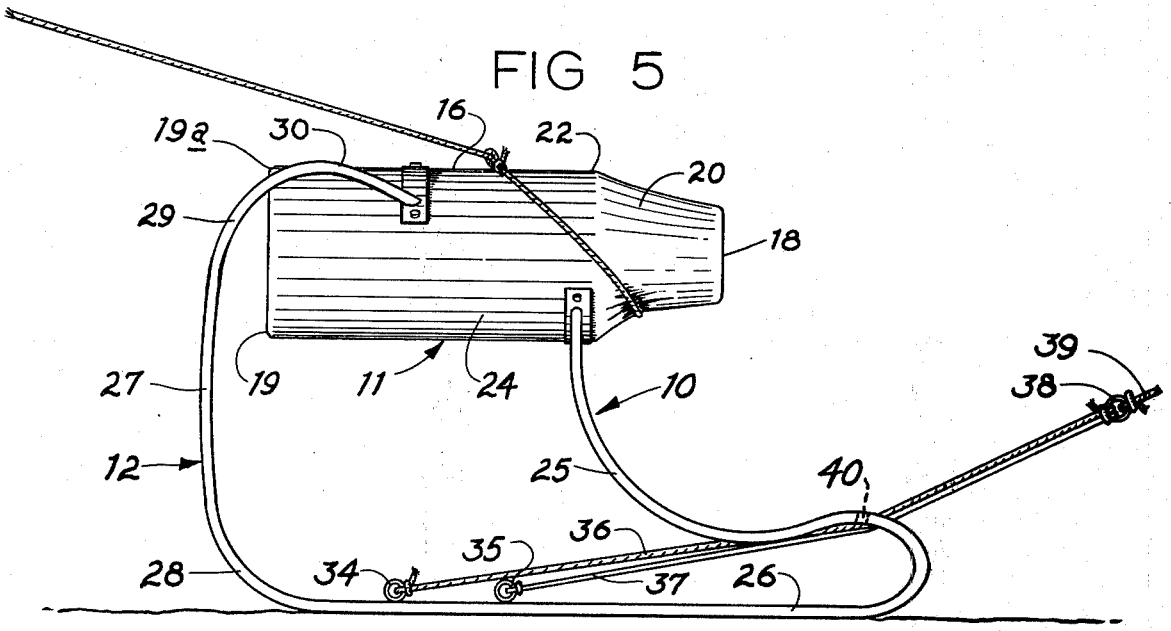
FIG. 5 shows a lasso loop engaged with the calf training aid.

A training aid comprising a preferred form of the present invention is illustrated in the drawings and is designated therein by the reference character 10. Basically, the training aid 10 is comprised of a calf shaped body 11 supported on runners 12 for sliding along the ground as a practice target for calf roping.

Figure 7:
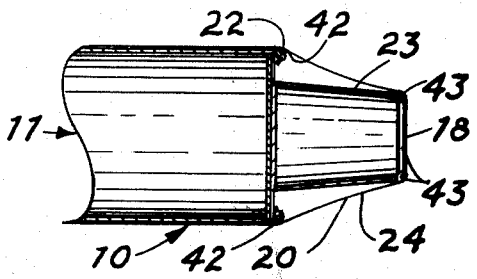
FIG. 7 is a section view of the forward end of the calf training aid.

As shown, body 11 is substantially cylindrical along its length from a rearward end 19 to a forward shoulder 22. A head 20 is included with body 11, extending forwardly from the shoulder 22 to a forward body end 18. Head 20 is formed by a rigid conical support 23 (FIG. 7) extending forwardly from shoulder 22 and converging toward forward end 18. Support 23 is substantially smaller in cross sectional dimension than the corresponding dimension of body 11 at shoulder 22.

A flexible fabric covering 24 preferably encloses body 11 from end 18 to rearward end 19. The covering 24 is held taut between the reduced forward end 18 and shoulder 22. The flexible covering 24 therefore defines the outward shape of head 20 as that portion of body 11 tapering forwardly from shoulder 22 to reduced forward end 18. As may be noted in FIG. 7, the covering 24 between end 18 and shoulder 22 is spaced outwardly of the rigid conical support 23. In operation, this covering portion 24 provides a resilient roping surface that enables quick release of a lasso loop, and will be discussed further below.

The runners 12 movably support body 11 above the ground at an elevation approximating the height of an average calf. The runners are formed of specially bent matching tubes 25. The lengths of tubes 25 will be divided into sections according to the function each performs for the purpose of this description.

The first matching sections may then be described as a horizontal pair of skids 26. These longitudinal skids 26 are utilized as means for holding body 11 substantially parallel with the ground surface in a loop receiving position while enabling sliding movement of the aid in a forward path along the ground. The skids 26 are spaced apart laterally by a distance greater than the width of body 11 to prevent it from tipping sideways when roped.

Figure 6:
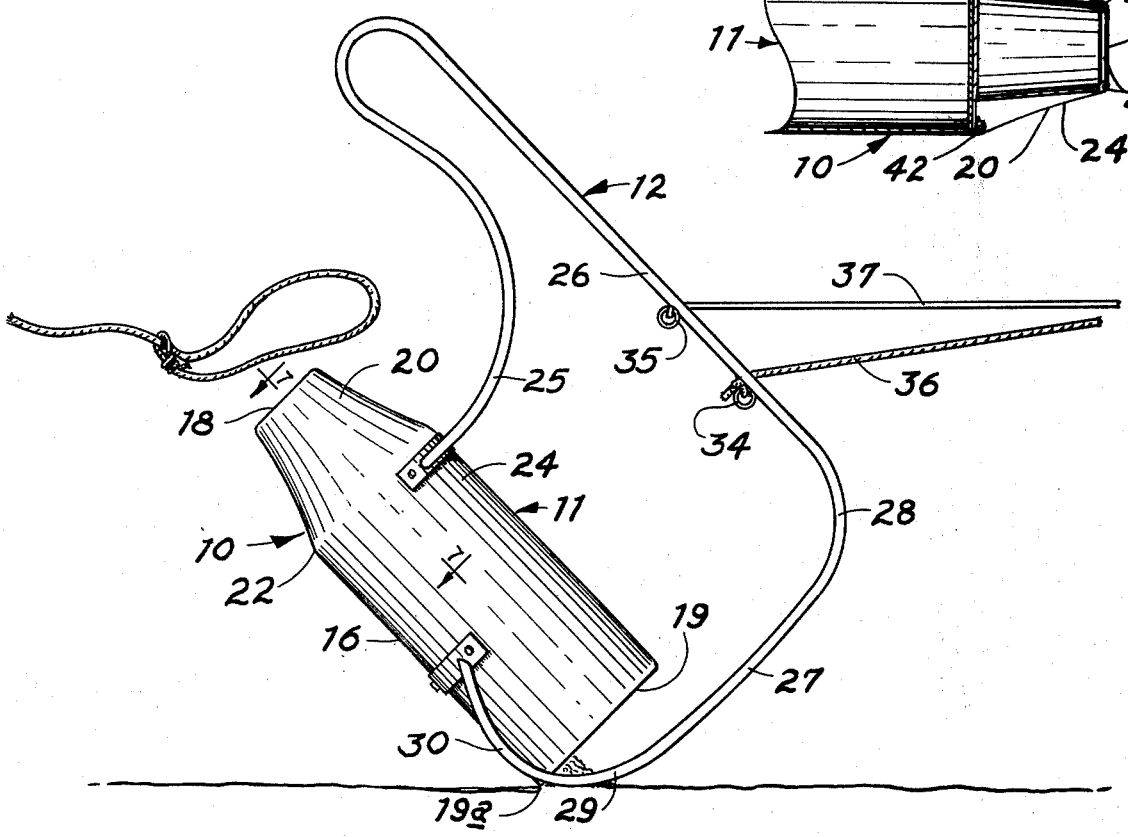
FIG. 6 shows a release of the lasso loop from the calf training aid.

Other sections include a pair of upright skids 27 that are tangentially joined to horizontal skid sections 26. Upright skids 27 provide means for enabling rocking movement of the body 11 to a loop releasing position (FIG. 6). The skid sections 27 are joined to horizontal skids 26 by curved, rocker skid portions 28 located rearward of body end 19. The upright skids 27 extend vertically from curved portions 28 to a point slightly below a top side 16 of body 11, rearward of body end 19. An additional pair of curved tubular sections 29 at the upper ends of skids 27 lead tangentially into top skid sections 30. These upper horizontal sections 30 extend forwardly from curved sections 29 to the top body side 16 then curve inwardly to be connected to body 11. The upper sections 29 and 30 function similarly to skids 26 in that they prevent the body 11 from tipping laterally onto its side when roped and pulled backward toward the loop releasing position (FIG. 6).

It is important to note the elevational difference between the upper skid sections 30 and top edge **19*a* of rearward body end 19. As shown in FIGS. 1, 5 and 6, this body edge 19*a* projects slightly above the tube sections 30 at rearward body end 19. Edge 19*a* will drag along the ground surface (FIG. 6) when the aid is roped and pulled rearwardly to the rope releasing position. Resistance to further rearward tipping movement is increased as dirt gathers ahead of the forwardly moving edge 19*a*. The increasing resistance to further rearward tipping movement facilitates the return rocking movement of the aid to the loop receiving position as shown in FIG. 5. This feature is utilized partially as means for returning body 11** back to the loop receiving position after being roped. Additional provisions are also made as will be seen below to insure proper return of the aid to this position.

A harness arrangement and specially placed connecting points on runners 12 also provide means for rocking the body back to the loop receiving position after being roped and tipped rearwardly in response to forward pulling force applied to the aid. FIGS. 5 and 6 show two sets of harness receiving eyelets 34 and 35. The first eyelets 34 are aligned across the runners, each fixed to a respective skid section 26 (FIG. 2). A rope harness member 36 is connected at opposite ends to the eyelets 34. A second set of eyelets 35 are spaced forward of the first set 34 and are fastened to opposed ends of a resilient harness member 37. Both harness members 36 and 37 are connected by a central ring member 38 that, in turn, is fastened to the tow rope 39 (FIG. 5). As may be noted in FIG. 5, the forward eyelets 35 are closer to ring 38 than the rearward eyelet set 34. However, when the body 11 is lassoed and tipped rearwardly, these distances reverse, with the resilient harness member 37 stretching against the forward pulling force. After the lasso loop has been released from head portion 20, the resilient member will contract to its normal length and by doing so, tip the body 11 forwardly onto the horizontal skid sections 26.

To aid in pulling the device and to enable quick rocking movement to the loop releasing position, a cross bar 40 is provided between the runners 12 forward of the body front end 18. The harness assembly is held below this bar 40 and, when the device is pulled along, produces a slight upward force at forward body end 18. This reduces weight at the forward body end 18 and shifts more weight toward the curved, rocking sections 28 of runners 12. When the head portion 20 is lassoed, relatively little rearward force is required to rock the aid rearwardly on sections 28, 27 and 29 to the loop releasing position.

The flexible fabric 24 prevents damage to the lasso rope and, more importantly, plays an important role in the release of the lasso when the aid reaches the loop releasing position. Preferably, the material 24 is stretched to a taut condition between forward body end 18 and shoulder 22. The taut covering 24 will therefore spring outwardly against a loop tightened about the head 20 and shoulder 22 as shown in FIG. 5. This continuous outward force serves to loosen the loop of the lasso when the body rocks rearwardly and subsequently allows it to slide freely over the tapered head 20 and clear of body 11. To prevent the material 24 from fraying unnecessarily and to provide a smooth and clean roping surface for the lariats, I provide a rounded bead or ring 42 at the body shoulder 22 about which the material 24 is molded. An additional bead 43 is provided about the periphery of the forward support end. The covering 24 extends over the rounded beads 42 and 43 to present a smooth even outward surface for roping and for releasing the loop.

In operation, the aid proves to be very versatile. To begin with, the aid may be utilized either as a roping target for a person(s) while riding or standing on the ground. The device may also be used both as a stationary target or as a moving target for a mounted roper(s). The aid is particularly helpful in training a "green" horse to follow a moving object in the process of roping. In addition, a fresh horse may be used to pull the aid until he becomes tired and therefore more suited for calf roping.

Preferably, when the device is in use, a first rider pulls the aid along the ground at a relatively slow speed. A student roper then rides up behind the aid, and throws a loop over head portion 20. He then jerks the rope right and throws the rope slack forward and upwardly of his still advancing horse. When the slack is taken up, the forwardly moving body 11 will tilt backwardly in response to the opposite pulling forces. As the aid rocks rearwardly, the loop slips from the head portion 20. The instant the loop is released, the forward pulling force produced by the first rider works against the aid to pull it back to the original loop receiving position. This readies the aid to be roped again, without necessitating that either rider stop to remove the rope or set the aid upright.

During training, an experienced roper may pull the aid while giving instructions to an inexperienced roper behind. He may, while working slowly with the trainee, give helpful advice as the aid is pulled along as to how to dismount and work his horse from the ground in backing up to keep the rope tight until the aid rocks back to release the loop. Or, the device may be pulled along behind any appropriate towing vehicle while a group of riders ride along behind taking turns roping the aid. In this manner, group instruction may be given from a single person riding along on the towing vehicle.

It should be noted that continued forward progress of the aid is never halted even though it is roped and flipped over backward by a roper and his horse. The continued pulling force along the towing rope serves to flip the body 11 from the loop releasing position back to the loop receiving position without halting forward progress of the towing vehicle.

The above description and attached drawings are given by way of illustration to set forth a preferred form of the present invention, it being understood that various changes and modifications may be made therein. It is therefore intended that only the following claims be taken as definitions of my invention.

What I claim is:

1. A calf roping training aid adapted to be towed along the ground in a forward direction as a roping target for a calf roper, comprising:

a simulated calf body with forward and rearward facing ends;

a longitudinal bottom side normally facing downwardly and a longitudinal top side normally facing upwardly;

a hornless head portion at the forward body end adapted to receive and slidably release the loop of a lariat, said head portion tapering forwardly from the forward body end to a reduced nose end;

means for movably supporting the body in a loop receiving position above ground with the body and head portion oriented substantially parallel to the ground surface and with the bottom side facing the ground surface;

rocker means responsive to rearward force directed against the forward body end while the aid is being towed in a forward direction for rocking the body and head portion rearwardly about a horizontal axis to bring the top side to a downwardly facing condition and the head to a rearwardly facing loop releasing position; and return means responsive to forward pulling force for rocking the body and head portion back to the loop receiving position.

2. The training aid as defined by claim 1 wherein said support means includes:

a horizontal skid for slidably holding the body parallel to the ground while being towed; and wherein said rocker means includes an upright skid tangentially joined to the horizontal skid rearwardly of the body to affect rocking movement of the body to the loop releasing position in response to forward pulling force.

3. The training aid as defined by claim 2 wherein the upright runner portion extends upwardly from the horizontal runner portion on the bottom body side rearward of the rearward body end, then forwardly and downward to be joined to the body on the top side forward of the rearward end.

4. The training aid as defined by claim 1 wherein:

the body is generally cylindrical in cross section;

the head is comprised of a rigid support of less cross sectional dimension than the corresponding cross sectional dimension of the body at the forward body end, projecting forwardly therefrom to the reduced nose end; and a flexible material connected between the forward body end and nose end and encompassing the rigid support.

5. The training aid as defined by claim 1 wherein the return means comprises a rope connector means located on the skid means adjacent the ground and toward the rearward body end.

6. The training aid as defined by claim 5 further comprising:

a harness rope connected to said first rope connector means;

a second connector means on the skids adjacent the ground and forward of the first rope connector means;

an elastic rope connected to said second connector means; and a gathering ring receiving the harness rope and elastic rope and adapted to be connected to a main tow rope forward of the training aid.

7. The training aid as defined by claim 5 further comprising an earth engaging abutment edge on said body at the rearward facing end thereof for engaging and dragging along the ground when the body is in the loop releasing position.

* * * * *